US007936321B2

(12) United States Patent
Park

(10) Patent No.: US 7,936,321 B2
(45) Date of Patent: May 3, 2011

(54) DRIVING CIRCUIT AND ORGANIC ELECTROLUMINESCENCE DISPLAY THEREOF

(75) Inventor: Yong Sung Park, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1032 days.

(21) Appl. No.: 11/599,982

(22) Filed: Nov. 16, 2006

(65) Prior Publication Data

US 2007/0279336 A1 Dec. 6, 2007

(30) Foreign Application Priority Data

Jun. 5, 2006 (KR) ..... 10-2006-0050481

(51) Int. Cl.
*G09G 3/30* (2006.01)

(52) U.S. Cl. ..... 345/76

(58) Field of Classification Search ..... 345/76–104, 345/204; 341/144–154
See application file for complete search history.

(56) References Cited

U.S. PATENT DOCUMENTS

| | | | |
|---|---|---|---|
| 5,877,717 | A | 3/1999 | Tu et al. |
| 6,781,536 | B1 | 8/2004 | Martins |
| 7,034,732 | B1 | 4/2006 | Fackenthal et al. |
| 7,239,567 | B2 | 7/2007 | Kwon |
| 7,595,776 | B2 | 9/2009 | Hashimoto et al. |
| 2004/0048069 | A1 | 3/2004 | Yamada |
| 2004/0189572 | A1 * | 9/2004 | Nose ..... 345/92 |
| 2005/0168416 | A1 | 8/2005 | Hashimoto et al. |
| 2007/0052641 | A1 | 3/2007 | Hagino et al. |

FOREIGN PATENT DOCUMENTS

| | | |
|---|---|---|
| JP | 04-237091 | 8/1992 |
| JP | 05-181436 | 7/1993 |
| JP | 11-064825 | 3/1999 |
| JP | 2001-272655 | 10/2001 |
| JP | 2004-4788 | 1/2004 |
| JP | 2004-212668 | 7/2004 |
| JP | 2004-246182 | 9/2004 |

(Continued)

OTHER PUBLICATIONS

Search Report issued in corresponding European Patent Application No. 07251958.0 dated Sep. 20, 2007.

(Continued)

*Primary Examiner* — Sumati Lefkowitz
*Assistant Examiner* — Robert E Carter, III
(74) *Attorney, Agent, or Firm* — Christie, Parker & Hale, LLP

(57) ABSTRACT

A driving circuit capable of decreasing an error of a gray level voltage without affecting a voltage drop when a gray level signal of a D/A converter is generated in an analog switch, and an organic electroluminescence display using the same. The driving circuit includes first and second switch units to select respective first and second reference voltages to correspond to a data signal; a resistor including a plurality of resistor arrays to receive and distribute the first and second reference voltages by utilization of at least two resistances to generate a gray level voltage; a third switch unit to select one resistor array out of the plurality of arrays to correspond to the data signal and to transmit the first and second reference voltages to the selected resistor array; and a fourth switch unit to output the gray level voltage, generated by the resistor array, to correspond to the data signal.

23 Claims, 6 Drawing Sheets

FOREIGN PATENT DOCUMENTS

| | | |
|---|---|---|
| JP | 2004-343746 | 12/2004 |
| KR | 10-2002-0004281 | 1/2002 |
| KR | 10-2003-0068480 | 8/2003 |
| KR | 10-2004-0075628 | 8/2004 |
| KR | 10-2006-0019800 | 3/2006 |

OTHER PUBLICATIONS

Notice of Allowance issued in Korean Patent Application No. 10-2006-0050482 on Nov. 30, 2007.
Office Action issued by the Japanese Patent Office in Japanese Patent Application No. 2006-199921 on Dec. 8, 2009.
U.S. Office Action dated Feb. 5, 2010, issued in corresponding U.S. Appl. No. 11/645,678.
U.S. Office Action dated Apr. 16, 2010, issued in corresponding U.S. Appl. No. 11/647,336.
Search Report issued in corresponding European Patent Application No. 07251958.0 dated Sep. 20, 2007.
Notice of Allowance issued in Korean Patent Application No. 10-2006-0050482 on Nov. 30, 2007.
Office Action issued by the Japanese Patent Office in Japanese Patent Application No. 2006-199921 on Dec. 8, 2009.
U.S. Appl. No. 11/645,678, filed Dec. 27, 2006, Yong Sung PARK, Samsung Mobile Display Co., Ltd.
U.S. Appl. No. 11/647,336, filed Dec. 29, 2006, Yong Sung PARK, Samsung Mobile Display Co., Ltd.

* cited by examiner

DRIVING CIRCUIT AND ORGANIC ELECTROLUMINESCENCE DISPLAY THEREOF

CROSS-REFERENCE TO RELATED APPLICATIONS

This application claims the benefit of Korean Patent Application No. 2006-50481, filed on Jun. 5, 2006, in the Korean Intellectual Property Office, the disclosure of which is incorporated herein by reference.

BACKGROUND OF THE INVENTION

1. Field of the Invention

Aspects of the present invention relate to a driving circuit and an organic electroluminescence display using the same, and more specifically, to a driving circuit capable of decreasing a gray level error to improve linearity by preventing a voltage drop generated in an analog switch, and an organic electroluminescence display using the same.

2. Description of the Related Art

A flat panel display has a plurality of pixels arranged in a matrix type pattern on a substrate as a display area, and a scan line and a data line connected to each pixel to display an image by selectively applying a data signal to the pixels.

Flat panel displays are classified into passive matrix-type light-emitting displays and active matrix-type light-emitting displays according to a driving mode of respective pixels. The active matrix-type light-emitting displays which turn on the light by individual pixels has been mainly used terms of a high resolution, good contrast and fast operating speed.

Active matrix flat panel displays have been used as displays in such applications as personal computers, portable phones, PDAs, etc., or as monitors of various information appliances, and active matrix flat panel displays have been fabricated of liquid crystal displays (LCDs) using a liquid crystal panel, organic electroluminescence displays using an organic electroluminescence devices, plasma display panels (PDPs) using plasma panels, etc., as have been known in the art.

Recently, various light-emitting displays having a smaller weight and volume than a cathode ray tube have been developed, and attention has been particularly paid to the organic electroluminescence display which exhibits excellent luminous efficiency, a luminance and viewing angle and has a rapid response time.

FIG. 1 is a circuit view showing a configuration of a conventional organic electroluminescence display 10. Referring to FIG. 1, the organic electroluminescence display includes a pixel unit 100, a data driving unit 200 and a scan driving unit 300.

The pixel unit 100 includes a plurality of data lines (D1, D2 . . . Dm−1,Dm) and a plurality of scan lines (S1,S2 . . . Sn−1,Sn), and a plurality of pixels formed in a region defined in a plurality of the data lines (D1,D2 . . . Dm−1,Dm) and a plurality of the scan lines (S1,S2 . . . Sn−1,Sn). The pixel 101 includes a pixel circuit and an organic electroluminescence device, and the pixel 101 generates a pixel current in the pixel circuit to flow to the organic electroluminescence device, the pixel current flows in the pixels according to data signals transmitted through a plurality of the data lines (D1,D2 . . . Dm−1,Dm) and scan signals transmitted through a plurality of the scan lines (S1,S2 . . . Sn−1,Sn).

The data driving unit 200 is connected with a plurality of the data lines (D1,D2 . . . Dm−1,Dm), and generates data signals to sequentially transmit a row of data signals to a plurality of the data lines (D1,D2 . . . Dm−1,Dm). The data driving unit 200 also has a (digital-to-analog) (D/A) converter, and generates a gray level voltage which is converted from a digital signal into an analog signal by the D/A converter, thereby to transmit the gray level voltage to the data lines (D1,D2 . . . Dm−1,Dm).

The scan driving unit 300 is connected to a plurality of scan lines (S1,S2 . . . Sn−1,Sn), and generates a scan signal to transmit the scan signal to a plurality of the scan lines (S1, S2 . . . Sn−1,Sn). A certain row is selected by the scan signals, and a data signal is transmitted to a pixel 101 arranged in the selected row, such that a current corresponding to the data signal is generated in the pixel.

FIG. 2 is a circuit view showing a resistance unit which generates a gray level voltage in a conventional D/A converter. Referring to FIG. 2, assume that the resistance unit generates eight gray level voltages for illustration. In order to generate eight gray level voltages, eight resistances (R1, R2, . . . R8) are connected in series, and a first reference voltage having a high voltage (VrefH) and a second reference voltage having a low voltage (VrefL) are respectively transmitted to both ends of the resistances connected in series, and then the first reference voltage and the second reference voltage become a gray level voltage distributed by the eight resistances. At this time, the first reference voltage and the second reference voltage are selected from a plurality of voltages, and a voltage drop is generated in switches due to an error of resistances in an ON state of the switches which select each of the first reference voltages and the second reference voltages, resulting in generation of an offset voltage. Also, a plurality of the first reference voltages and a plurality of the second reference voltages are not made linear due to the resistance differences of the switches which select the first reference voltage and the second reference voltage.

SUMMARY OF THE INVENTION

Accordingly, aspects of the present invention are designed to solve such drawbacks of the prior art, and/or realize additional advantages and therefore an aspect of the present invention is to provide a driving circuit to decrease an error of a gray level voltage without affecting a voltage drop when a gray level signal of a D/A converter is generated in an analog switch, and an organic electroluminescence display using the same.

An aspect of the present invention provides an organic electroluminescence display including a pixel unit, a data driving unit and a scan driving unit, wherein the data driving unit includes a first switch to select a first reference voltage to correspond to a data signal; a second switch to select a second reference voltage to correspond to the data signal; a resistor including a plurality of resistor arrays to receive the first reference voltage and the second reference voltage and to distribute the first reference voltage and the second reference voltage at least two resistances to generate a gray level voltage; a third switch to select one resistor array out of the plurality of the resistor arrays to correspond to the data signal and to transmit the first reference voltage and the second reference voltage to the selected resistor array; and a fourth switch to output the gray level voltage, generated by the resistor array, to correspond to the data signal.

Another aspect of the present invention provides a driving circuit, including a first switch to select one voltage out of a plurality of voltages, to select the voltage as a first reference voltage; a second switch to select a lower voltage than the voltage selected by the first switch to select the lower voltage as a second reference voltage; a plurality of resistor arrays whose respective first ends receive the first reference voltage from the first switch and whose second ends receive the second reference voltage from a third switch, and to divide and output voltages of the first ends and the second ends; the third switch to select one resistor array out of the plurality of the resistor arrays; and a fourth switch to select one resistor array out of the plurality of the resistor arrays so that the first reference voltage and the second reference voltage are distributed by the resistor arrays.

Further aspects of the present invention provide a method to drive an organic electroluminescence display, including using an upper bit of a data signal to select a first reference voltage and a second reference voltage; using a lower bit of the data signal to select one resistor array out of a plurality of resistor arrays each having a different resistance ratio; and distributing the first reference voltage and the second reference voltage by the selected resistor array to generate a gray level voltage.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
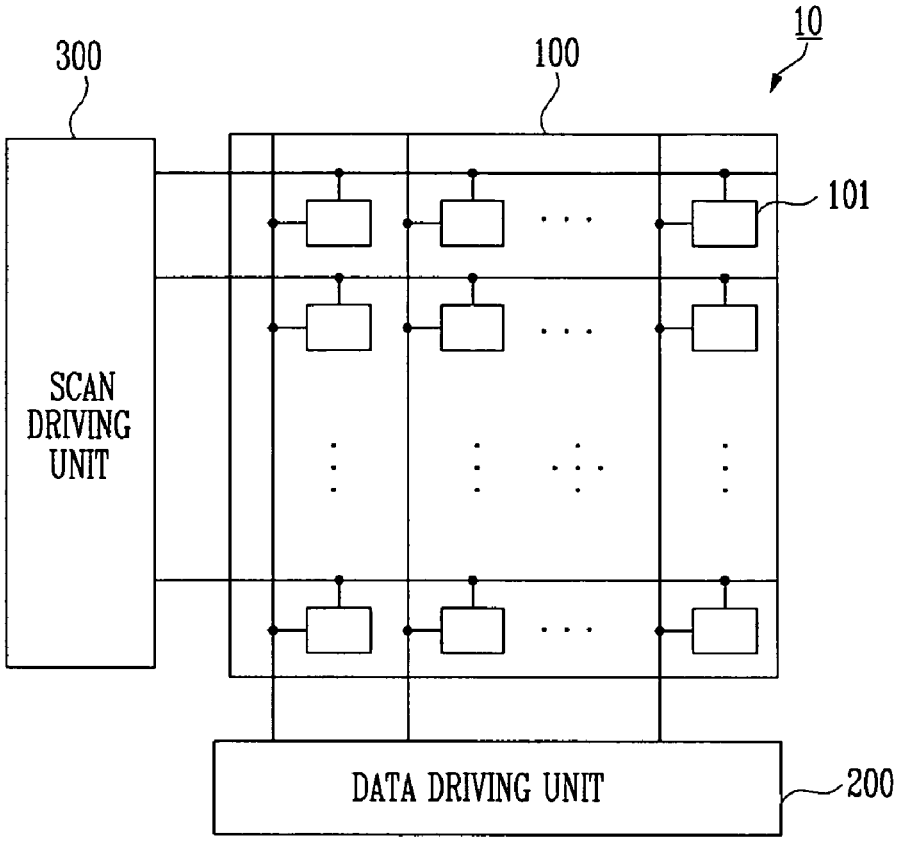
FIG. 1 (PRIOR ART)
FIG. 1 is a circuit view showing a configuration of a conventional organic electroluminescence display.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Here, when one element is connected to another element, one element may be not only directly connected to the other element but also indirectly connected to the other element via another element. Further, irrelative elements are omitted for clarity.

Figure 3:
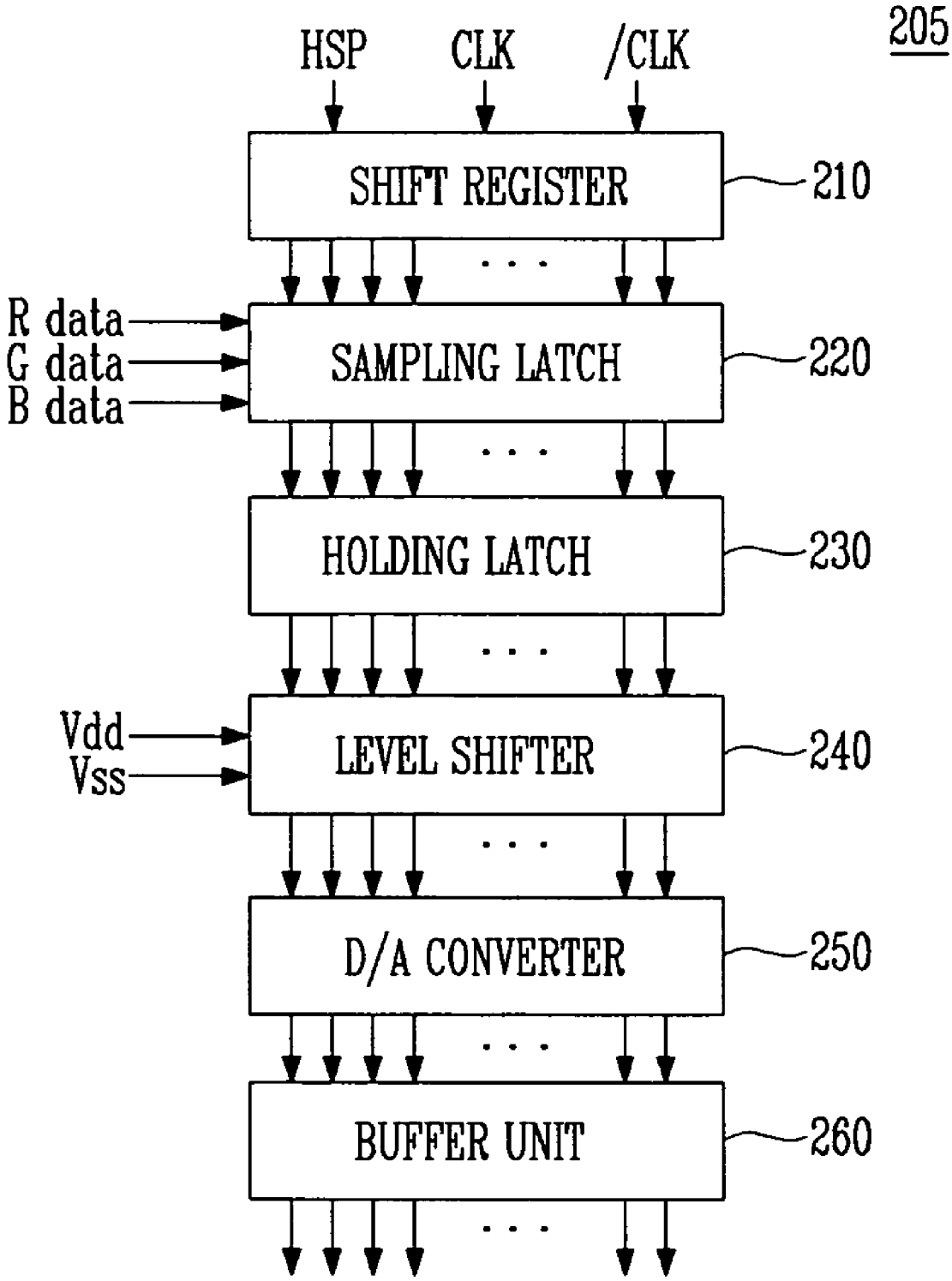
FIG. 3 is a circuit view showing a data driving unit used in an organic electroluminescence display according to an embodiment of the present invention.

FIG. 3 is a circuit view showing a data driving unit used in an organic electroluminescence display according to an embodiment of the present invention. Referring to FIG. 3, the data driving unit 205 includes a shift register 210, a sampling latch 220, a holding latch 230, a level shifter 240, a D/A converter 250 and a buffer unit 260.

The shift register 210 is comprised of a plurality of flip flops, and controls the sampling latch 220 to correspond to a clock signal (CLK) and a synchronizing signal (Hsync). The sampling latch 220 sequentially receives a row of data signals according to a control signal of the shift register 210, and then outputs the data signals in parallel. A mode for sequentially receiving a signal and outputting the signal in parallel is referred to as Serial In Parallel Out (SIPO). The holding latch 230 receives the signal in parallel, and then outputs the signal in parallel. A mode for receiving a signal in parallel and outputting the signal in parallel is referred to as Parallel In Parallel Out (PIPO). The level shifter 240 changes a level of the signal, outputted from the holding latch 230, into an operating voltage of the system and transmits the operating voltage to the D/A converter 250. The D/A converter 250 transmits the signal, received as the digital signal, as an analog signal to select a corresponding gray level voltage and transmits the gray level voltage to the buffer unit 260, and the buffer unit 260 amplifies the gray level voltage, and then transmits the amplified gray level voltage to data lines.

Figure 4:
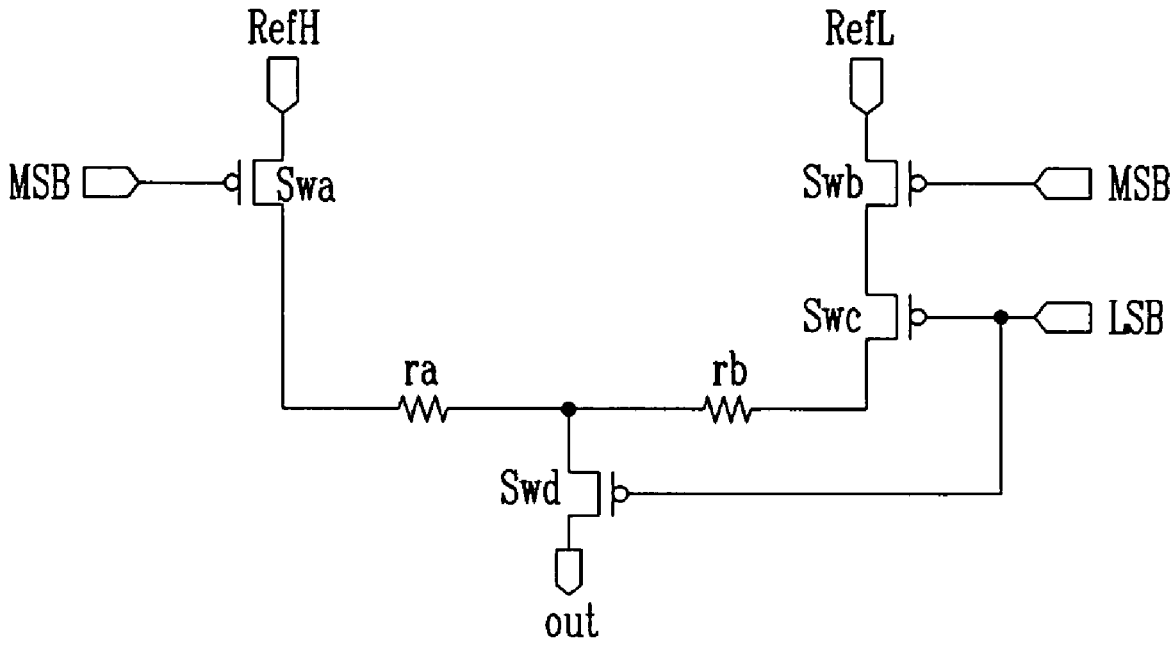
FIG. 4 is a circuit view schematically showing a D/A converter of the organic electroluminescence display according to an embodiment of the present invention.

FIG. 4 is a circuit view schematically showing a circuit to generate a gray level voltage in a D/A converter of the organic electroluminescence display according to an embodiment of the present invention. Referring to FIG. 4, the gray level voltage is generated by receiving a first reference voltage (RefH) and a second reference voltage (RefL) and distributing the voltages to correspond to the first reference voltage (RefH) and the second reference voltage (RefL). The circuit for generating the gray level voltage includes a first switch (Swa) to select the first reference voltage (RefH) and to transmit the selected first reference voltage (RefH) to a first end of resistor arrays (ra,rb); a second switch (Swb) to select the second reference voltage (RefL); a third switch (Swc) connected to the second switch (Swb) to transmit the second reference voltage to a second end of the resistor arrays (ra, rb); resistor arrays (ra,rb) to distribute a voltage corresponding to a difference between the first reference voltage (RefH) and the second reference voltage (RefL), thereby generating a gray level voltage; and a fourth switch (Swd) to switch and transmit the generated gray level voltage. The first switch (Swa) and the second switch (Swb) determine respective switching operations using an upper bit of a data signal, and the third switch (Swc) and the fourth switch (Swd) determine respective switching operations using a lower bit of the data signal.

In the circuit as configured above and shown in FIG. 4, the gray level voltage is determined by a ratio of Ra+ra to Rb+Rc+rb, where Ra, Rb, and Rc are ON resistance of the first switch (Swa), second switch (Swb), and third switch (Swc), respectively. A resistance of the switches is adjusted to Ra=Rb+Rc, and then the gray level voltage is determined by a ratio of ra to rb when the ON resistance of the first switch (Swa) is lower than the ra and rb resistances. Accordingly, when one of the first to third switches (Swa), (Swb), (Swc) is in the ON state, then the offset voltage may not be generated and a non-linearity of the first and second reference voltages may be prevented since the voltage drop caused by the switch resistance should not be considered.

Figure 5A:
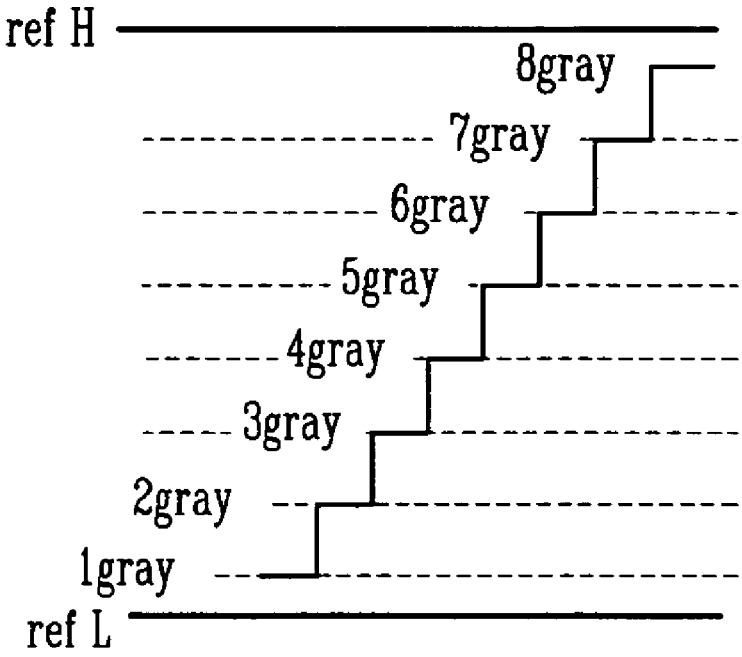
FIGS. 5A and 5B are diagrams showing respectively gray level voltages of the conventional D/A converter and the D/A converter according to the embodiment of the present invention shown in FIG. 4.
Figure 5B:
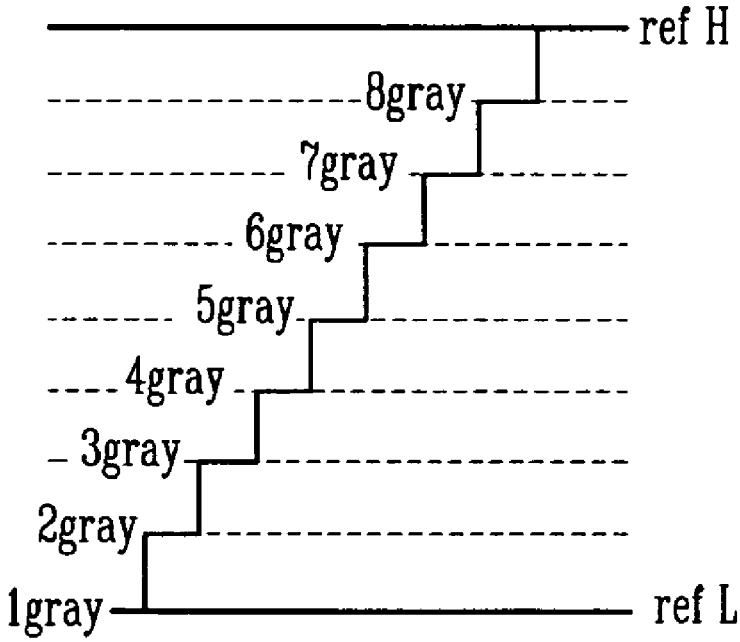

FIGS. 5A and 5B are diagrams showing gray level voltages of the conventional D/A converter and the D/A converter according to aspects of the present invention, respectively.

In the case of the conventional D/A converter shown in FIG. 5A, the gray level voltage is higher by the offset voltage than the LOW voltage (ref L) when a gray level 0 (1gray) is displayed due to the voltage drop by the switch, and therefore a current flows through the data line even though the gray level 0 is displayed. Accordingly, a power consumption may be increased and a black color may not be accurately represented.

In the D/A converter according to aspects of the present invention, shown in 5B, a current flows, however, through the data line even though the gray level 0 (1gray) is displayed since the gray level voltage is in a LOW voltage (refL) when a gray level 0 (1gray) is displayed because the voltage drop by the switch does not affect the gray level voltage. Accordingly, a power consumption may be decreased and a black color may be accurately represented.

Figure 6:
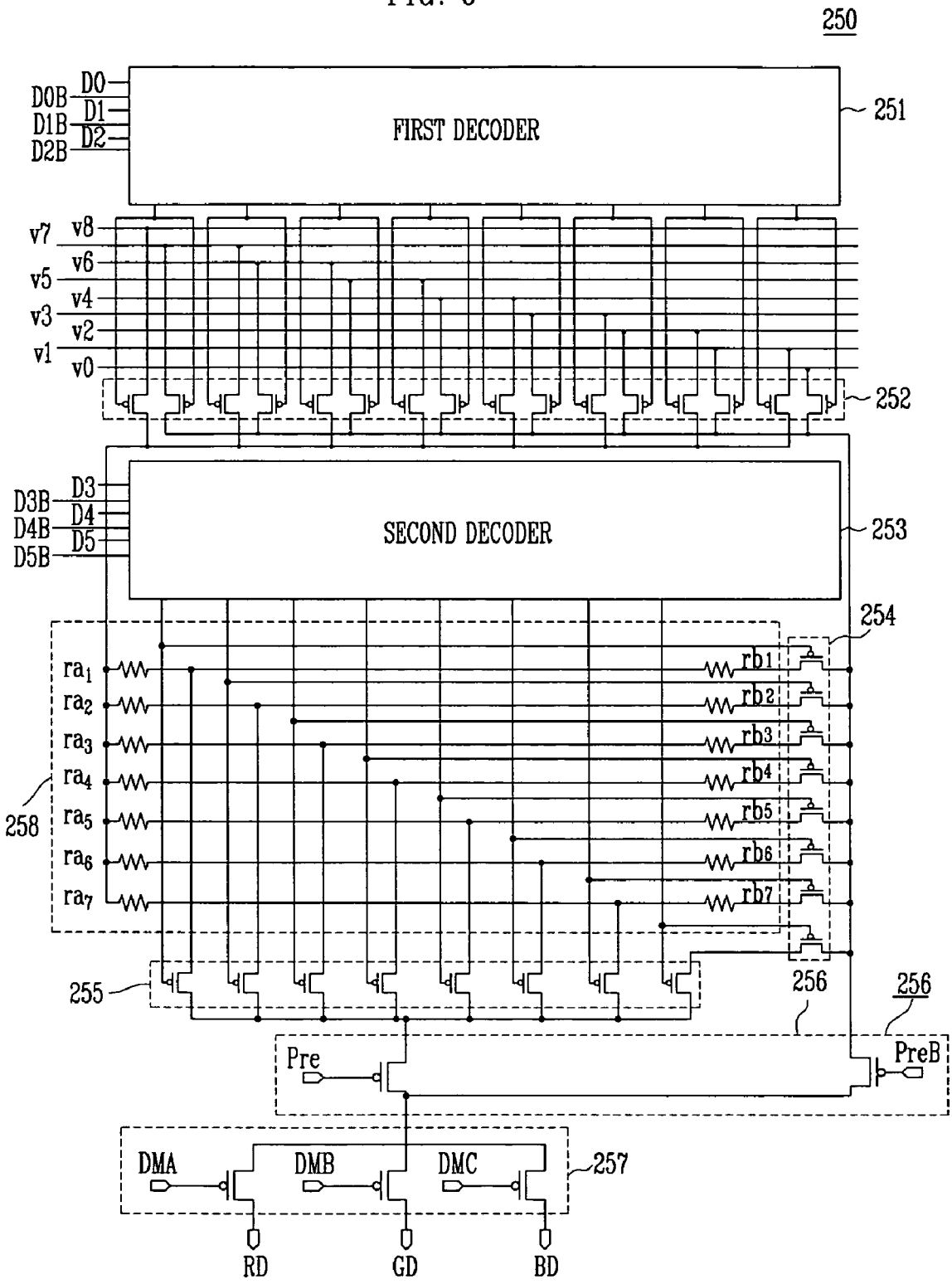
FIG. 6 is a schematic view showing a configuration of the D/A converter according to another embodiment of the present invention.

FIG. 6 is a schematic view showing a configuration of the D/A converter according to aspects of the present invention. Referring to FIG. 6, the D/A converter includes a first decoder 251, a first switching unit 252, a resistor 258, a second decoder 253, a second switching unit 254, a third switching unit 255, a MUX circuit 257 and a precharge circuit 256.

The first decoder 251 receives three input signals and outputs the three input signals through eight output terminals so as to generate signals having eight gray levels. The three input signals use an upper three bits of the data signal. The first switching unit 252 comprises a total of sixteen transistors, and each transistor is connected to output terminals of the first decoder 251. The first decoder 251 is connected to the first switching unit 252 as follows. The first transistor is connected to bus line v8, the second transistor is connected to bus line v7, the third transistor is connected to bus line v7, the fourth transistor is connected to bus line v6, etc., until, the fifteenth transistor is connected to bus line v1 and the sixteenth transistor is connected to bus line v0 as the connection pattern is repeated. Two transistors are connected to each output terminal of the first decoder 251, that is, gates of the first transistor and the second transistor are connected to the first output terminal of the first decoder 251, and gates of the third transistor and the fourth transistor are connected to the second output terminal of the first decoder 251, etc., such that gates of the remaining transistors are connected by continuing this pattern as described above, where gates of two transistors are connected to each output terminal of the first decoder 251. Therefore, an ON/OFF operation is carried out in the 16 transistors to correspond to the output signal of the first decoder 251.

The second decoder 253 selects one resistor array out of the resistor arrays 258 to which the first reference voltage and the second reference voltage, classified into the eight voltage levels by the first switching unit 252, are transmitted respectively, and then the first reference voltage and the second reference voltage are distributed by using the selected resistor array. The second decoder 253 outputs the eight signals using a lower three bit signal out of the data signal.

The resistor 258 has resistor arrays connected in parallel, the resistor arrays having two resistances connected in series, and one end of the resistor 258 is connected to the first reference voltage (RefH) and another end of the resistor 258 is connected to the second reference voltage (RefL) through the second switching unit 254. A third switching unit 255 is formed between the two resistances (ra,rb) of each resistor array. The second switching unit 254 and the third switching unit 255 carry out respective ON/OFF operations to correspond to the eight signals outputted from the second decoder 253. Accordingly, one resistor array is selected by the second switching unit 254, and the first reference voltage (RefH) and the second reference voltage (RefL) are distributed by using the two resistances (ra,rb) existing in the selected resistor array, and then a gray level voltage distributed and formed by the third switching unit 255 is outputted. At this time, the ratios of two resistances (ra,rb) in each resistor array are listed in the following Table 1.

TABLE 1

| Grey Level | ra | rb |
|---|---|---|
| 7 | 7R | R |
| 6 | 6R | 2R |
| 5 | 5R | 3R |
| 4 | 4R | 4R |
| 3 | 3R | 5R |
| 2 | 2R | 6R |
| 1 | R | 7R |
| ' | 0 | 0 |

Accordingly, the gray level voltages are determined to correspond to a difference between the first reference voltage (RefH) and the second reference voltage (RefL) and a resistance ratio of the two resistances.

And, the gray level voltage generated by the resistor 258 is transmitted to one line out of a plurality of the data lines through the MUX circuit 257. At this time, the data line is reset by the second reference voltage (RefL) in the precharge circuit 256 formed between the third switching unit 255 and the MUX circuit 257, followed by transmitting the second reference voltage (RefL) to the data line through the MUX circuit 257. In the precharge circuit 256, a transistor carries out an ON/OFF operation by use of an additional control terminal.

Figure 2:
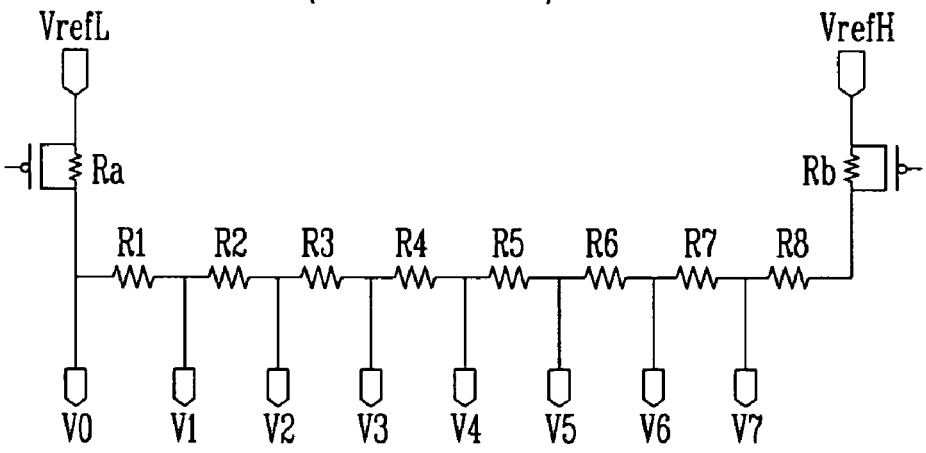
FIG. 2 (PRIOR ART)
FIG. 2 is a circuit view showing a resistance unit which generates a gray level voltage in a conventional D/A converter.
Figure 7:
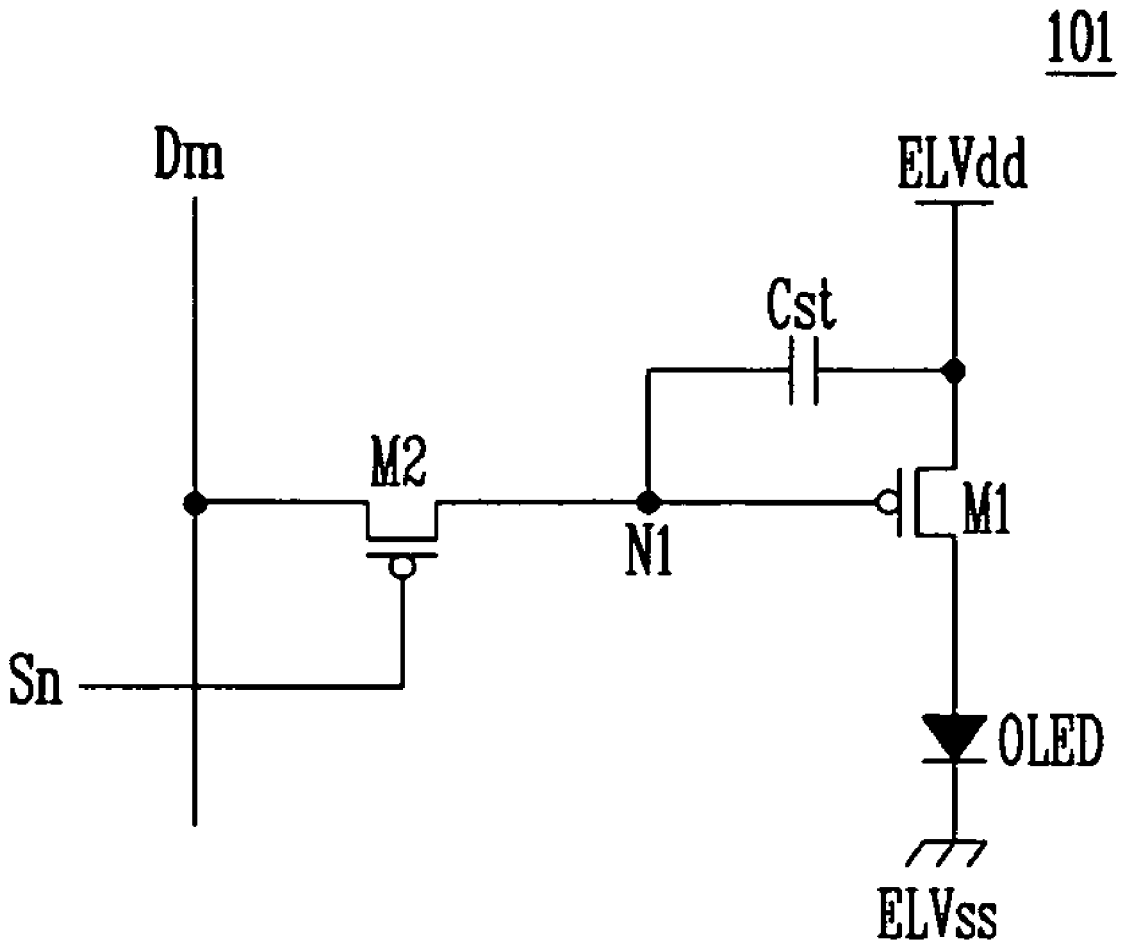
FIG. 7 is a circuit view showing one example of the pixel used in the organic electroluminescence display as shown in FIG. 1.

FIG. 7 is a circuit view showing one example of the pixel used in an organic electroluminescence display such as shown in FIG. 2. Referring to FIG. 7, the pixel is connected to the data line (Dm), the scan line (Sn) and the pixel power line (ELVdd), and includes a first transistor (M1), a second transistor (M2), a capacitor (Cst) and an organic electroluminescence device (OELD).

In the first transistor (M1), a source is connected to the pixel power line (ELVdd), a drain is connected to the organic electroluminescence device (OELD) and a gate is connected to the first node (N1). In the second transistor (M2), a source is connected to the data line (Dm), a drain is connected to the first node (N1), and a gate is connected to the scan line (Sn). The capacitor (Cst) is connected between the first node (N1) and the pixel power line (ELVdd) to maintain a voltage between the first node (N1) and the pixel power line (ELVdd) during a predetermined period. The organic electroluminescence device (OELD) includes an anode electrode, a cathode electrode and an emitting layer, wherein if the anode electrode is connected to a drain of the first transistor (M1) and the cathode electrode is connected to a low-potential power resource (ELVSS) so as to allow a current to flow from an anode electrode to a cathode electrode of the organic electroluminescence device (OELD) to correspond to the voltage which is applied to the gate of the first transistor (M1), then the light is emitted in the emitting layer and a brightness is adjusted to correspond to a capacity of the current.

The D/A converter according to aspects of the present invention and the organic electroluminescence display using the same, exhibit improved linearity since a voltage drop is not generated in an analog switch, and therefore the organic electroluminescence display gray level representation is more natural and a stable gray level voltage may be outputted by the D/A converter. Also, offset voltage of the D/A converter is not generated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic electroluminescence display comprising:

a pixel unit to display an image, the pixel unit comprising pixels, a data driving unit to connected to the pixels to generate display signals in the pixels; and a scan driving unit to generate a current corresponding to the display signals in the pixels;

wherein the data driving unit comprises:

a first switch unit to select a first reference voltage to correspond to a data signal;

a second switch unit to select a second reference voltage to correspond to the data signal;

a resistor including a plurality of resistor arrays to receive the first reference voltage and the second reference voltage and to distribute the first reference voltage and the second reference voltage by use of at least two resistances to generate a grey level voltage;

a third switch unit to select one resistor array out of the plurality of the resistor arrays to correspond to the data signal and to transmit the first reference voltage and the second reference voltage to the selected resistor array; and a fourth switch unit to output the grey level voltage, generated by the resistor array, to correspond to the data signal, wherein the plurality of resistor arrays comprise resistor arrays connected in parallel, and wherein each resistor array comprises a first resistance and a second resistance connected in series.

2. The organic electroluminescence display according to claim 1, wherein a plurality of the resistor arrays included in the resistor are formed so that at least two resistances have a different voltage ratio.

3. The organic electroluminescence display according to claim 1, wherein an ON resistance of the first switch unit is identical to a sum of ON resistances of the second and third switch units.

4. The organic electroluminescence display according to claim 1, wherein the fourth switch unit is connected to a plurality of data lines, and selects one data line out of the plurality of the data lines to transmit the grey level voltage.

5. The organic electroluminescence display according to claim 4, comprising a precharge circuit connected between the fourth switch unit and a plurality of the data lines to precharge a voltage in a plurality of the data lines using the second reference voltage.

6. The organic electroluminescence display according to claim 1, wherein the first reference voltage and the second reference voltage are selected using a first bit of the data signal, and the resistor array is selected using a second bit lower than the first bit of the data signal.

7. The organic electroluminescence display according to claim 1, wherein the third switch unit comprises switches, and wherein each of the switches of the third switch unit is respectively connected to a corresponding resistor array between the first resistance and the second resistance of the corresponding resistor array.

8. A driving circuit comprising:

a first switch unit to select one voltage out of a plurality of voltages to select the voltage as a first reference voltage;

a second switch unit to select a lower one of the plurality of voltages than the voltage selected by the first switch unit to select the lower one of the plurality of voltages as a second reference voltage;

a plurality of resistor arrays whose first end receives only the first reference voltage from only the first switch unit and whose second end receives only the second reference voltage from only the second switch unit, and dividing and outputting voltages of the first end and the second end;

a third switch unit connected between the second switch unit and the second end of the plurality of resistor arrays to select one resistor array out of the plurality of the resistor arrays so that the first reference voltage and the second reference voltage are distributed by use of the resistor arrays; and a fourth switch unit to select one resistor array out of the plurality of the resistor arrays to transmit a grey level voltage.

9. The driving circuit according to claim 8, wherein an ON-state resistance of the first switch unit is identical to a sum of an ON-state resistance of the second switch unit and an ON-state resistance of the third switch unit.

10. The driving circuit according to claim 8, wherein each resistor array includes a first resistance and a second resistance, wherein a ratio of the first resistance to the second resistance is set to different values according to the resistor arrays.

11. The driving circuit according to claim 10, wherein the third switch unit comprises switches, and wherein each of the switches of the third switch unit is respectively connected to a corresponding resistor array between the first resistance and the second resistance of the corresponding resistor array.

12. The driving circuit according to claim 8, further comprising:

a first decoder to transmit a first selection signal to select the first reference voltage and the second reference voltage out of the plurality of the voltages to the first switch unit and the second switch unit; and a second decoder to output a second selection signal to select one resistor array out of the plurality of the resistor arrays to output a voltage distributed by a resistance of the selected resistor array.

13. The driving circuit according to claim 12, wherein the first decoder uses a first bit of a data signal to generate the first selection signal, and the second decoder uses a second bit lower than the first bit of the data signal to generate the second selection signal.

14. The driving circuit according to claim 8, wherein a plurality of data lines are connected to the fourth switch unit to which the grey level voltage is transmitted, and the grey level voltage is transmitted to one data line out of the plurality of the data lines by a switching operation.

15. The driving circuit according to claim 8, further comprising a precharge circuit connected between the fourth switch unit and a plurality of data lines, to precharge a voltage in the plurality of the data lines using the second reference voltage.

16. A method of driving an organic electroluminescence display, comprising:

using a first bit of a data signal to select a first reference voltage and a second reference voltage;

using a second bit lower than the first bit of the data signal to select one resistor array out of a plurality of resistor arrays having different resistance ratios; and distributing the first reference voltage and the second reference voltage by use of the selected resistor array to generate a grey level voltage, wherein the plurality of resistor arrays comprise resistor arrays connected in parallel, and wherein each resistor array comprises a first resistance and a second resistance connected in series.

17. The method of driving the organic electroluminescence display according to claim 16, wherein the selecting of the first reference voltage and the second reference voltage further comprises transmitting the selected second reference voltage to a data line.

18. The method of driving the organic electroluminescence display according to claim 16, wherein the selected resistor array is selected by a switching unit having switches, and wherein each of the switches of the third switch unit is respectively connected to a corresponding resistor array between the first resistance and the second resistance of the corresponding resistor array.

19. A D/A converter, comprising:

a first switch unit to select a first reference voltage;

a second switch unit to select a second voltage lower than the first reference voltage as a second reference voltage;

a plurality of resistor arrays whose first end receives the first reference voltage from the first switch unit and whose second end receives the second reference voltage from a third switch unit, and to divide and output a voltage of the first end and the second end, wherein a third switch unit selects one resistor array out of the plurality of resistor arrays so that the first reference voltage and the second reference voltage are distributed by the resistor array; and a fourth switch unit to output a grey level voltage generated by the resistor array, wherein the plurality of resistor arrays are directly connected to both the second switching unit and the third switching unit.

20. An organic electroluminescence display comprising:

a pixel unit comprising pixels to display an image;

a data driving unit to generate display signals in pixels of the pixel unit, wherein the data driving unit comprises the D/A converter of claim 19; and a scanning unit to generate a current corresponding to the display signals in the pixels of the pixel unit.

21. The D/A converter according to claim 19, wherein an ON resistance of the first switch unit equals the sum of the ON resistances of the second and third switch units so that a voltage drop in the first, second and third switch units does not affect the grey level voltage.

22. The D/A converter according to claim 19, wherein the plurality of resistor arrays comprise resistor arrays connected in parallel, wherein each resistor array comprises a first resistance and a second resistance connected in series and a ratio of the first resistance to the second resistance is set to different values according to the resistor arrays.

23. The D/A converter according to claim 22, wherein the third switch unit comprises switches, and wherein each of the switches of the third switch unit is respectively connected to a corresponding resistor array between the first resistance and the second resistance of the corresponding resistor array.

* * * * *

UNITED STATES PATENT AND TRADEMARK OFFICE

CERTIFICATE OF CORRECTION

PATENT NO. : 7,936,321 B2
APPLICATION NO. : 11/599982
DATED : May 3, 2011
INVENTOR(S) : Yong Sung Park It is certified that error appears in the above-identified patent and that said Letters Patent is hereby corrected as shown below:

In the Claims

| | |
|---|---|
| Column 9, Claim 18, line 16 | Delete "third" |
| Column 7, Claim 1, line 10 | After "unit"<br>Delete "to" |

Signed and Sealed this
Thirteenth Day of March, 2012

David J. Kappos

David J. Kappos
*Director of the United States Patent and Trademark Office*